US005090581A

United States Patent [19]

Rose et al.

[11] Patent Number: 5,090,581

[45] Date of Patent: Feb. 25, 1992

[54] BOTTLE CAPS

[75] Inventors: Howard Rose, Cheshire; Ian G. C. McAffer, Kent, both of Great Britain

[73] Assignee: Waverley Pharmaceuticals, Ltd., Great Britain

[21] Appl. No.: 593,858

[22] Filed: Oct. 31, 1990

Related U.S. Application Data

[63] Continuation-in-part of Ser. No. 322,901, Mar. 14, 1989, Pat. No. 5,007,546.

[30] Foreign Application Priority Data

Jul. 14, 1987 [GB] United Kingdom ..... 8716514

[51] Int. Cl.[5] ..... B65D 1/02

[52] U.S. Cl. ..... 215/32; 215/253

[58] Field of Search ..... 215/32, 250, 251, 253

[56] References Cited

U.S. PATENT DOCUMENTS

| | | | |
|---|---|---|---|
| 4,096,962 | 6/1978 | Riuli et al. | 215/32 |
| 4,526,279 | 7/1985 | Weiler et al. | 215/32 |
| 4,662,529 | 5/1987 | Moore | 215/32 |

*Primary Examiner*—Stephen P. Garbe
*Assistant Examiner*—Nova Stucker
*Attorney, Agent, or Firm*—Waldron & Associates

[57] ABSTRACT

The present invention relates to bottle caps for use with blow-fill-seal type bottles having an upwardly removable seal, the caps having inwardly projecting members, at least one of which is equipped with a blade and preferably an upstanding wall to engage the seal of the bottle, the wall being preferably recurved away from the seal, such caps allowing thicker frangible membranes to be used in the manufacture of the bottles so that there is less wastage, the caps also permitting easier end-use and a higher success ratio for seal-removal.

26 Claims, 3 Drawing Sheets

BOTTLE CAPS

This application is a continuation-in-part of co-pending U.S. application Ser. No. 07/322,901, filed Mar. 14, 1989 now U.S. Pat. No. 5,007,546, which is a continuation of PCT/GB88/00569 filed July 14, 1988 now abandoned.

FIELD OF THE INVENTION

The present invention relates to a bottle cap for use with molded plastics bottles which have an integral flanged seal over the aperture of a threaded neck, a frangible membrane joining the seal to the neck, the cap having a complementary screw-thread to that of the neck and at least two inwardly projecting resilient members located above the screw-thread such that, when the cap is screwed onto the bottle, the members pass around the seal with resilient deformation and, on unscrewing of the cap, engage the flanged seal in a lifting action.

PRIOR ART

The invention lies in the field of containers for sterile liquids. Traditionally, a bottle is filled with the relevant liquid and a lid screwed on tightly. The sealed bottle may then be autoclaved, irradiated, or similar, to ensure sterility. To maintain sterility, a sealing ring may be provided. However, such systems are prone to breakage of the seal, and such breakage can be difficult or impossible to detect in normal use.

In recent years, sterile containers for medicines and the like have overcome some problems by being made from sealed plastic bottles, for example. Such bottles create problems of their own with regard to opening. Using a knife is inherently dangerous, and can leave a ragged edge unsuitable for pouring.

A large variety of systems have been proposed to overcome these disadvantages.

The bottle disclosed in EP-A-50490 is representative of the early art, where a cap is provided which breaks the seal when it is screwed down. Specifically, a cover is formed over the neck during the molding operation. During the molding operation a V-shaped groove is formed in an annular portion situated above the thread of the neck to provide a frangible section. The bottle is opened by screwing its cap downwards, thereby breaking the frangible portion. A ring inside the upper part of the cap then locates inside an annular groove in the cover so that, on unscrewing the cap, the sheared-off cover can be removed from the neck.

In GB Patent 2080775, a closure element, formed separately from the bottle, is heated sealed onto the neck of the bottle. The line where the closure is sealed onto the bottle is weaker than the rest of the bottle so that the closure can be broken off, and this is achieved by a jacking ring located in the cap. The jacking ring comprises fingers which snap into a recess above the heat seal and, as the jacking ring is unscrewed upwards, the cover is removed.

Unfortunately, both of the above systems are prone to a large proportion of wastage, as the seal will often distort, rather than break at the weakened area. The system disclosed in EP-A-194068 (U.S. Pat. No. 4,662,529) seeks to overcome this problem and, likewise, has a seal over a screw-threaded neck. The seal comprises a downwardly facing abutment portion in which a frangible membrane is located. Fingers in the cap directly engage the abutment portion, limiting the possibility of deformation of the seal without breaking.

In FIG. 2 of EP-A-194068 (U.S. Pat. No. 4,662,529) (reproduced herewith as FIG. 6), the fingers 9 are intended to act to break off the seal 6 when the cap 7 is unscrewed. The fingers 9 have horizontal upper surfaces which abut the undersurface of seal 6 at the annular portion 4. Thus, the unscrewing of the cap gives rise to a jacking action, intended to stretch the membrane 5 and prise off the seal 6 from the remainder of the cap.

Nevertheless, there are still problems in producing in high volume the bottles of the art, primarily arising from difficulties in reproducibly molding the bottle itself in a manner such that the frangible portion is strong enough to resist fracture during handling but weak enough to be stretched and broken by the jacking action upon unscrewing the cap. Thus, wastage continues to be a problem, as the frangibility of the weakened portion is remains critical.

Further, problems also arise because of the flexibility of the fingers, especially in warm climates, when they tend to buckle and fail to remove the seal.

U.S. Pat. No. 4,526,279 seeks to tackle the above problems by providing a reinforcing wall on the finger. A flat portion of the finger engages the underside of the seal whilst an upwardly projecting wall engages the side of the seal. The edge of the seal is thus caught in a cleft of the finger, making it that much more difficult for the finger to buckle. Despite this apparent advantage, there is no noticeable improvement in performance over earlier bottles.

Accordingly, there is currently no bottle-and-cap combination on the market which overcomes the inherent problems associated with upwardly removable seals, performance being little better than for those bottles employing downwardly removable seals. All variations currently available have a wastage rate of up to about 25% at the factory alone, a rate still further increased at the point of use. None of the variations described above overcome the requirement for the thinnest possible frangible membrane to be provided for the seal to be removable.

The problem is exacerbated by it not being possible to accurately establish whether any given bottle has a membrane of suitable thickness when it comes off the machine. Manual checks are constantly necessary, as a hairsbreadth change in the thickness can result either in leakage, or a membrane which simply cannot be ruptured. Such measurement is necessarily empirical, as rupturability of the membrane by the existing methods worsens after the subsequent processing.

Subsequent processing will usually include autoclaving as, although most applications use the blow-fill-seal method, constant adjustment of the cutters to ensure correct membrane thickness means that the cutters are not sterile. The autoclaving leads to a change in the crystalline structure of the plastic, which is not understood, but which makes the plastic less easy to rupture.

Attempts to allow the use of thicker membranes, therefore, have come to naught.

Accordingly, it is an object of the invention to replace bottles with downwardly removable seals.

It is a further object to provide bottles with a lower degree of wastage.

It has now been now found that bottles having substantially thicker frangible membranes than were heretofore of practical application can be used with bottle caps of the present invention.

SUMMARY OF THE INVENTION

The present invention is characterized in that each of at least one, preferably at least two, and ideally 6, of the inwardly projecting members comprises an upwardly directed blade adapted to engage an underface of the seal. In a preferred embodiment, the blade member(s) further comprise a reinforcing wall adapted to engage a side of the seal.

In a preferred aspect, the invention provides a bottle cap for use with molded plastics bottles of the type having an integral flanged seal covering the aperture of a threaded neck;

the flange having an underface and the seal having a side, a frangible membrane being located in the underface of the flange and joining the seal to the neck, the cap having a complementary screw-thread to the thread of the neck and at least two inwardly projecting resilient members located above the screw-thread, at least one of the inwardly projecting resilient members having a generally upwardly projecting blade and an upwardly projecting reinforcing wall adapted for engagement of the side of the seal, the resilient members being adapted to pass over the seal with resilient deformation when the cap is screwed onto the bottle, and, wherein on unscrewing of the cap, at least one blade is adapted to engage the underface of the flanged seal, characterized in that the reinforcing walls are recurved from the side of the seal.

BRIEF DESCRIPTION OF THE DRAWINGS

FIG. 10 is an enlarged view of the area 100 of FIG. 8.

DETAILED DESCRIPTION OF THE INVENTION

Figure 1:
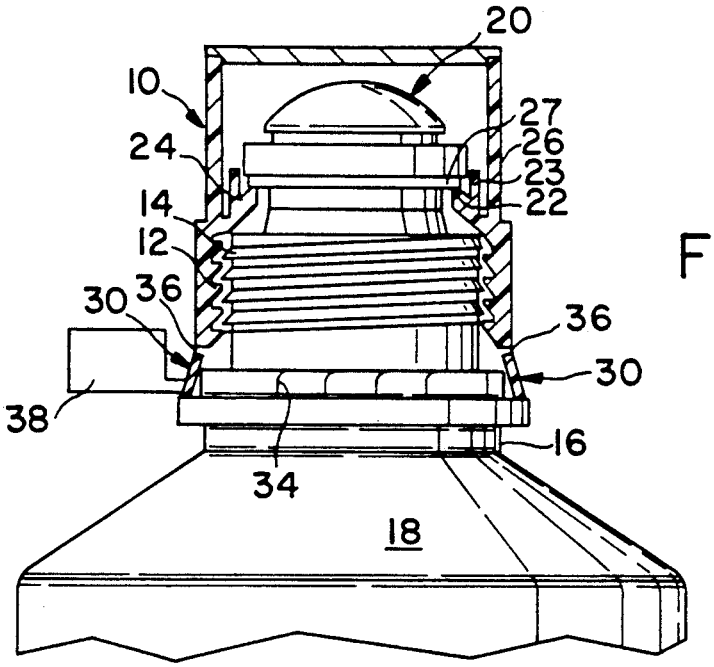
FIG. 1 is a vertical cross-section of a cap of this invention when threaded on the neck of a bottle.

Unscrewing of the cap causes upward movement of the blade(s) to cut in to the underface, preferably the frangible membrane, while prising the seal from the bottle, giving a more efficient severance of the seal. The reinforcing wall functions by acting against a side of the seal when upward pressure is applied, preventing buckling of the blade support.

In a preferred embodiment, the blade members are arranged in an interrupted annular ring, a total of 6 members being considered ideal from the point of view of strength and overall efficiency. However, any number may be employed, according to requirements. For maximum efficacy, the blade members are equally spaced apart in the ring.

In an alternative embodiment, the blade members are interspersed with non-cutting, cleft members, such as are described in U.S. Pat. No. 4,526,279. A total of three or four of each of the two types of member is preferred, although it is possible to provide just one blade and, for example, 3 cleft members. Other configurations will be apparent to those skilled in the art.

In order to retain the seal within the cap, the interrupted annular barrier ring formed by the blade members may also be supplemented by baffles between the blades. Alternatively, the baffles may be provided above or below the ring, provided that their purpose is served, and cutting is not hindered.

The blade, cleft and baffle members may be fused, or formed, directly into the cap, or they may be connected via one or more support arms. While the latter method tends to be weaker, it is preferable in some circumstances.

It is preferred to use recurved walls as defined. Thus, in one feature, the present invention provides bottle caps for use with blow-fill-seal type bottles having an upwardly removable seal, the caps having inwardly projecting members, at least one of which is equipped with a blade and an upstanding wall to engage the seal of the bottle, the wall being recurved away from the seal. Such caps allow thicker frangible membranes to be used in the manufacture of the bottles so that there is less wastage, and also permit easier end-use and a higher success ratio for seal-removal.

The frangible membrane may take any suitable form. In one simple embodiment, the frangible membrane is formed in the final stage of molding by using a cutter to form a weakened, or thinner, line in the underface of the flange. Such a technique is typically employed in the art.

Another suitable embodiment of frangible membrane is where all, or a portion, of the underface is rendered thinner during molding. This embodiment has the advantage that it is less crucial where the blades are located within the cap, but was not previously possible because of the critical importance of membrane dimension to function.

Thus, it is a particular advantage of the present invention that thicker membranes can be used. The failure rate of opening a bottle is drastically reduced, and bottle manufacture is made considerably easier with a further concomitant reduction in wastage. Using the systems of the art, when a cap engages the seal, if the user fails to open the bottle first time, screwing the cap down and trying again almost invariable fails. With the system of the present invention, the situation is reversed and, even where the first attempt proves unsuccessful, the second will usually work. Accordingly, the present invention provides for economies of up to about 50%, as well as providing a system operable by people of only average strength.

Preferred bottles for use in accordance with the present invention are those which are manufactured, filled and sealed in a single operation (blow-fill-seal bottles).

The term 'recurved' is used to indicate that the inner face of a wall adapted for engagement of the side of the seal does not have the same curvature as that portion of the side of the seal engageable by the wall. Accordingly, the recurved wall does not contact the side of the seal flat along its length, just for a part of it. Thus, the walls will generally be curved away from the side of the seal.

In general, it will be appreciated that the recurved wall may be curved just marginally away from the side of the seal, eccentrically away, straight so as to define a tangent, or be curved in the opposite sense. Any curvature of the wall may be in the form of a regular arc having a single focus, or it may have two or more foci, or may have no effective focus. The wall may be a simple upstanding rod, for example, or may even be a short wall following the curvature of the side of the seal and being recurved in the sense of having rounded edges. This latter embodiment is not a preferred embodiment, as the more wall that engages the side of the seal, the greater the binding, or drag, and the more difficult it becomes to unscrew the cap.

It is particularly preferred to provide low walls, so as to minimise binding, or friction. The walls may be as low as possible, provided that they still serve to engage the side of the seal. Alternatively, the walls may be vertically displaced from the side of the seal to achieve the same effect, or the seal itself may be dented or curved inwards to achieve the effect as required.

It is also particularly advantageous for that portion of the seal for engagement with the wall to fit snugly into the angle defined by the wall and the blade, or blade support, so as to provide good leverage.

The wall may be formed integrally with the blade, or provided separately, such as in the case of a metal rod, for example. In such a case, the rod may also be designed to rotate in its socket to reduce friction yet further but, for simplicity and ease of manufacture, integrally formed blades and walls are preferred and tend to be just as, or more, effective.

A particularly preferred form of wall is only about 1 mm high and has faces formed from two sectors. Thus, it may only have two faces in plan section. This format provides for maximum strength in the central section of the wall where the side of the seal is to be engaged.

Unscrewing of the cap causes upward movement of the blade(s) to cut into the underface of the seal, while prising the seal from the bottle, giving a more efficient severance of the seal. The reinforcing wall functions by acting against a side of the seal when upward pressure is applied, preventing buckling of the blade support. Not all of the walls in any one cap will necessarily act against the side of the seal, and it may be that none does unless the blade buckles slightly, bringing the wall into contact with the side of the seal. However, it is generally the case that a majority of walls will act against the seal during unscrewing of the cap and consequent removal of the seal.

A particular and surprising advantage lies in the fact that bottles with relatively thick frangible membranes can be used with the caps of the invention. It is now essentially possible to provide a production line for the bottles which does not have to be continuously checked, not because the production line has been in any way improved, but because there is greater tolerance in the usable thickness of the membrane. Thus, the machine can be tooled to provide thicker membranes, as variation in thickness is considerably less important. Accordingly, it is now easier to keep the entire operation sterile, thereby reducing or eliminating the need for autoclaving.

Preferably at least two, and ideally 3, of the inwardly projecting resiliently deformable members comprises an upwardly directed blade.

In practice, even where 3 blades are provided, it has been observed that the seal is engaged by just one blade which proceeds to tear the membrane.

It has been found to be particularly efficient to provide 3 blade members, especially spaced in only one semicircle defined by the inner side of the cap. Any more or less may be used, but a noticeable drop in efficiency results, with more blades leading to extra binding.

It is preferred to also employ seal retaining means in the cap. Suitable for this purpose are non-cutting, cleft members, such as are described in U.S. Pat. No. 4,526,279. Any number may be employed as required, but a total of three is preferred, especially arranged in a semicircle opposite the blade members. Other suitable means include baffles. The retaining means may be placed in any suitable position, provided that the purpose is served, and cutting is not hindered. In particular, it is preferred that the retaining means is located such that the blades will engage the underface of the seal first. Subsequent engagement of the underface by the retaining means may serve either to force or lift up the seal and assist in removal, or to retain the seal in the cap, or both.

The blades may be in any form suitable for achieving the purpose of the invention. A square edge has been found to be satisfactory, but curved edges may assist in avoiding catching in the cut surface.

In particular, it is advantageous to present a cutting point to the seal underface to puncture the seal. Once punctured, the seal becomes easier to sever, and may be cut by a wedging action using a blunt edge, an embodiment which works well and is easiest to form in practice.

The cap may also be provided with a tamper-proof ring below the thread, designed to engage a complementarily-shaped part on the container. Such tamper-proof rings are known in the art. For example, the tamper-proof ring can comprise a series of internal teeth or ratchets which engage with complementary teeth or ratchets on the bottle neck, making it impossible to remove the cap from the bottle until the tamper-proof ring has itself been removed, for example by rupture of the ring. To this end the ring can comprise a pull-tab and a line of weakness, such that grasping and pulling of the pull-tab leads to breaking away at the line of weakness of the ring from the rest of the cap.

The caps of the present invention may be made from any suitable material, but preferably from plastics, especially thermoplastics. Particularly preferred is tough, pharmaceutical grade polypropylene.

The caps may be made integrally or piecemeal. If the latter, then it is usual for the top of the cap to be snap-fitted, glued or heat-welded into place, and the blade members may be provided on an annular member adapted to seat above the screw-thread.

The latter can be particularly advantageous in that the blades may be formed from metal. There is then less chance of their buckling. The necessary resilience may be a quality of the metal itself, or the blade(s) may be seated in a plastics annulus, for example. The annulus may be inserted in the cap and seated in a convenient groove or upon a suitable shoulder or abutments. However, metal blades are generally potentially more dangerous and also lend complexity to cap manufacture, so that they may be less preferable.

The caps of the invention may be provided separately, together with a suitable bottle, in packs, or in other suitable methods of packaging. Although it is preferred that the bottles to be used are hermetically sealed, any bottle having a suitable upwardly removable portion on a screw-threaded member may be employed in conjunction with the caps of the present invention. Accordingly, the present invention also provides a cap, as defined, in association with a suitable bottle, especially as defined in the preamble to the preferred embodiment.

The bottles for use with the caps of the invention may also be made from any suitable material, such as polypropylene, polystyrene or polyethylene. Traditionally, polypropylene has been used for such bottles, and this material is suitable for the bottles of the invention. Polyethylene is a generally more desirable material, but has not found much application in the area of the invention owing to the necessity of autoclaving, which tends to melt and deform polyethylene. However, with modern autoclaving techniques, it has become possible to use polyethylene, and such bottles are preferred for use with the present invention.

Choice of bottle material may also affect the make-up of the cap, which may be made of the same material, but will normally be of a suitably hard material. Polypropylene is particularly prone to binding, and a preferred cap format has three blade members adjacent one another and opposite three support members. Polyethylene, on the other hand, is less prone to binding, and the generally less preferred format of 6 blade members has been found to work well, although 4 or 5 equally spaced blade members may also work wall, or an interspersed form of the 3+3 format, but the 3+3 format, as described for polypropylene, is most preferred.

Figure 2:
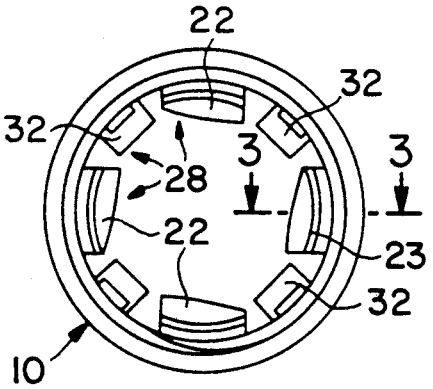
FIG. 2 is a view from beneath of an alternative cap of the invention.
Figure 3:
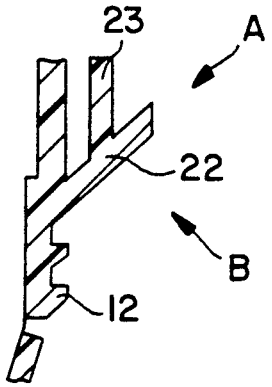
FIG. 3 is a vertical section on the line 3—3 of FIG. 2 through part of the cap of FIG. 1.
Figure 4:
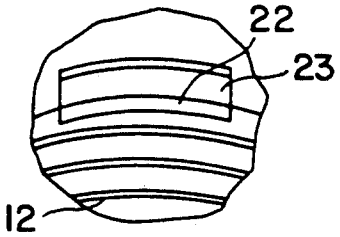
FIG. 4 is a view on arrow "A" of FIG. 3.
Figure 5:
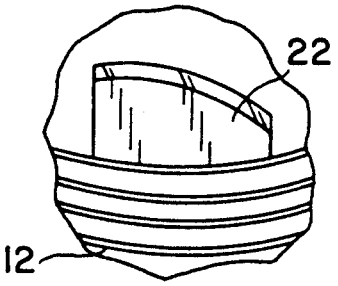
FIG. 5 is a view on arrow "B" of FIG. 3.
Figure 6:
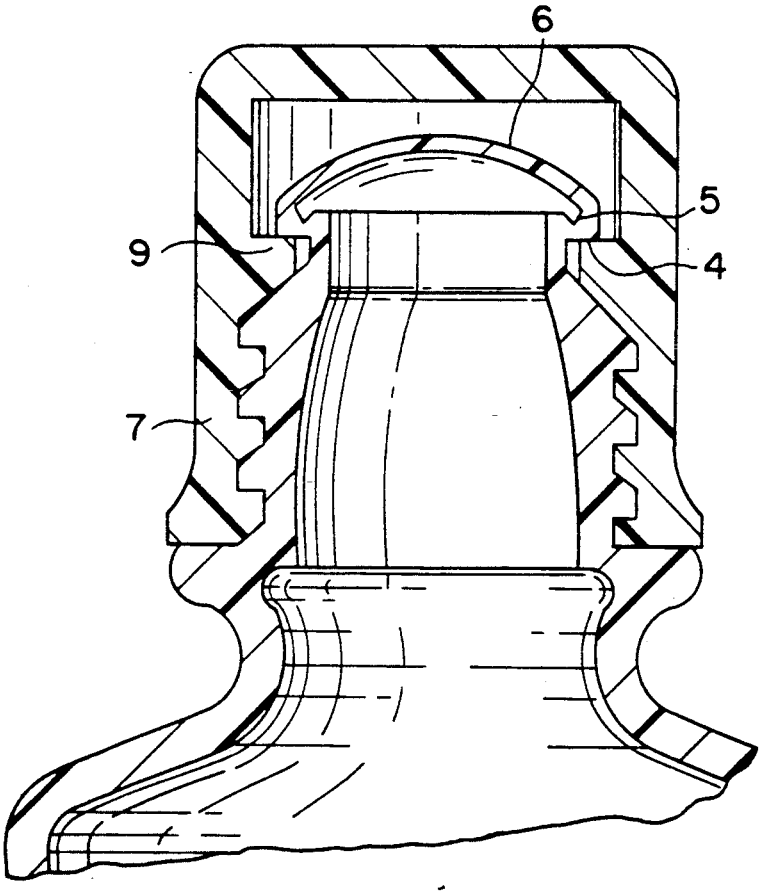
FIG. 6 PRIOR ART
FIG. 6 is a sectional view of a prior art bottle cap, the drawing being a reproduction of FIG. 2 from European Patent Publication Number 194068 (U.S. Pat. No. 4,662,529)

Turning now to the drawings, molded plastics cap 10 has a thread 12 complementary to the thread 14 of the neck 16 of a bottle 18. The bottle 18 has an integral seal 20 formed during the molding and filling of the bottle. Four internal, inwardly- and upwardly-directed blades 22 are shown in FIG. 2 for simplicity, although 6 are preferred, and are provided on the cap 10 and engage with an underface 24 of an annular portion 26 of the neck 16 of the bottle 18. The blades 22 are sufficiently flexible to slide over the seal 20 when the cap is screwed on to the thread 14 of the bottle 18. Wall 23 engages the side of the annular portion of the seal 26 to strengthen the blade 22 and to help to provide leverage.

The cap 10 is provided with a tamper-proof ring 30 below the thread 12 with a series of internal ratchets (not shown, being of conventional design) which engage with complementary ratchets 34 on the bottle neck 16, making it impossible to remove the cap from the bottle until the tamper-proof ring has itself been removed. The ring 30 is joined to the rest of the cap 10 by a line of weakness 36, and has a pull-tab 38.

Grasping and pulling of the pull-tab 38 leads to break away of the tamper-proof ring 30 at the line of weakness 36, allowing unscrewing of the cap 10.

Unscrewing of the cap 10 causes upward movement of the blades 22 to cut in to the underface while lifting the seal 20 from the bottle, giving an efficient severance of the seal at frangible membrane 27. Bending of the blades is prevented by the presence of walls 23. In order that the seal 20 is securely retained within the cap 10, the blades may be supplemented by barrier elements, such as baffles 32, to form an interrupted annular barrier ring 28.

Figure 7:
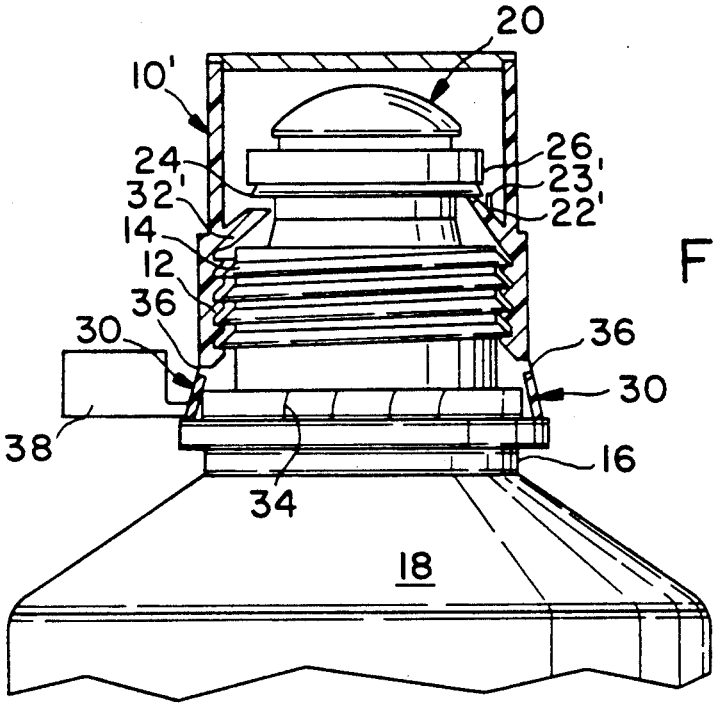
FIG. 7 is a vertical cross-section of an alternative cap of this invention when threaded on the neck of a bottle.
Figure 8:
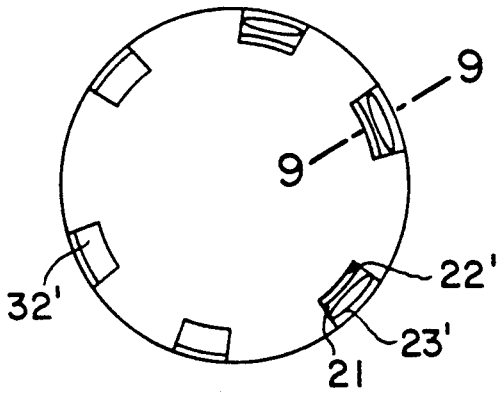
FIG. 8 is a plan showing the spatial arrangement of the baffles, blades and recurved walls of the cap of FIG. 7.
Figure 9:
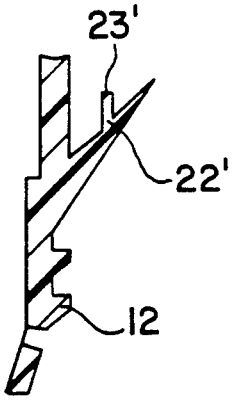
FIG. 9 is a vertical section on the line 9—9 of the cap of FIG. 8.

Turning to the embodiment of FIGS. 7 to 9, the numerals indicate similar features, as appropriate, to FIGS. 1 to 5. Three internal, inwardly- and upwardly-directed blades 22' are provided in cap 10', and wall 23' engages the side of the annular portion of the seal 26 to strengthen the blade 22' and to help to provide leverage.

Unscrewing of the cap 10' causes upward movement of the blades 22' to cut in to the underface while the area 21 between blade 22' and wall 23' helps to lift the seal 20 from the bottle, giving an efficient severance of the seal. Bending of the blades is prevented by the presence of walls 23'. In order that the seal 20 is securely retained within the cap 10', the blades may be supplemented by baffles 32' in the opposite half of the cap 10' as shown in FIG. 8.

We claim:

1. A bottle cap for use with molded plastic bottles which have an integral flanged seal over the aperture of the threaded neck and a frangible membrane joining the seal to the neck, the cap having a complementary screw-thread to that of the neck and a plurality of inwardly projecting resilient members located above the screw-thread such that, when the cap is screwed onto the bottle, the inwardly projecting members pass around the seal with resilient deformation and, on unscrewing the cap, engage the flanged seal in a lifting action, characterized in that at least one of said plurality of inwardly projecting members comprises:

a. an upwardly directed blade portion, adapted to engage an undersurface of the flanged seal, such that upon unscrewing of the cap, said upwardly directed blade portion will cut into the undersurface while lifting the flanged seal to provide an efficient severance of the seal from the bottle neck, and b. an upstanding wall portion adapted to engage a side of said flanged seal when upward pressure is applied and prevent buckling of said upwardly directed blade portion, said wall portion having a surface recurved from the side of said seal.

2. The cap of claim 1 wherein at least two of said plurality of inwardly projecting members are provided with blade portions.

3. The cap of claim 1 comprising at least two blade portions that are adjacent each other and opposite an equivalent number of said inwardly projecting members, all of said blades and said inwardly projecting members having regular spacing around said cap.

4. The cap of claim 1 wherein at least two of said plurality of inwardly projecting members include upwardly directed blade portions, and said blade portions further form an interrupted, annular ring within said cap.

5. The cap of claim 4 wherein said blade portions are substantially equally spaced around said cap.

6. The cap of claim 4 wherein at least one barrier element is interposed between two of said blade portions for the purpose of retaining the seal within said cap.

7. The cap of claim 4 having six of said inwardly projecting members with blade portions.

8. The cap of claim 1 wherein at least the cutting edge of said blade portion is metal.

9. A bottle as described in claim 1 having a cap as described in claim 1.

10. The cap of claim 1 wherein there are six (6) inwardly projecting members.

11. The cap of claim 10 wherein there are three (3) upwardly directed blade portions and three (3) barrier elements which together form an annular ring having each of said blade portions disposed in one semicircle of said ring.

12. A bottle cap for use with molded plastics bottles of the type having an integral flanged seal covering the aperture of a threaded neck;

the flange having an underface and the seal having a side, a frangible membrane being located in the underface of the flange and joining the seal to the neck, the cap having a complementary screw-thread to the thread of the neck and a plurality of inwardly projecting resilient members located above the screw-thread, at least one of the inwardly projecting resilient members having a generally upwardly projecting blade and an upwardly projecting reinforcing wall adapted for engagement of the side of the seal, the resilient members being adapted to pass over the seal with resilient deformation when the cap is screwed onto the bottle, and, wherein on unscrewing of the cap, at least one blade is adapted to engage the underface of the flanged seal, characterised in that each reinforcing wall is recurved from the side of the seal.

13. The cap of claim 12, wherein at least two of the plurality of inwardly projecting resiliently deformable members comprise an upwardly directed blade.

14. The cap of claim 13, wherein three of the plurality of inwardly projecting resiliently deformable members comprise an upwardly directed blade.

15. The cap of claim 12, wherein said reinforcing wall is formed integrally with said blade.

16. The cap of claim 12, wherein said reinforcing wall is about 1 mm high.

17. The cap of claim 12, wherein said reinforcing wall has faces formed from two opposing sectors.

18. The cap of claim 12, wherein the side of the seal for engagement with said reinforcing wall is adapted to fit snugly into an angle defined by said reinforcing wall and said blade.

19. The cap of claim 12, wherein the cap further comprises seal retaining members in the cap.

20. The cap of claim 19, wherein the retaining members are located such that the blades engage the underface of the seal first, on unscrewing of the cap.

21. The cap of claim 19, wherein the retaining members consist of one or more cleft members having an upstanding wall for engagement of the side of the seal and an inwardly directed portion adapted to engage the underface of the seal.

22. The cap of claim 19, wherein at least two resilient members, each having a blade, are adjacent each other and opposite an equivalent number of retaining members, all with regular spacing.

23. The cap of claim 19, wherein 3 resilient members, each having a blade, are adjacent each other and opposite an equivalent number of retaining members, all with regular spacing.

24. A cap as defined in claim 12 in association with a bottle as defined in claim 12.

25. The cap and bottle of claim 24, wherein the bottle is a blow-fill-seal bottle.

26. The cap and bottle of claim 24, wherein the bottle is made from a material selected from the group consisting of polypropylene, polystyrene and polyethylene.

* * * * *